United States Patent [19]

Moerkens et al.

[11] 4,353,007

[45] Oct. 5, 1982

[54] DISCHARGE LAMP UNIT INCLUDING INTEGRAL BALLAST

[75] Inventors: Jozef C. Moerkens; Leonard Woldring, both of Eindhoven, Netherlands

[73] Assignee: U.S. Philips Corporation, New York, N.Y.

[21] Appl. No.: 124,879

[22] Filed: Feb. 26, 1980

Related U.S. Application Data

[63] Continuation of Ser. No. 934,961, Aug. 18, 1978, abandoned.

[30] Foreign Application Priority Data

Aug. 23, 1977 [NL] Netherlands ..... 7709264

[51] Int. Cl.[3] ..... H01J 7/44; H01J 17/34; H01J 23/16; H01J 29/96; H01K 1/62

[52] U.S. Cl. ..... 315/62; 315/58; 313/493

[58] Field of Search ..... 315/47, 60, 61, 62, 315/59, 58; 313/493

[56] References Cited

U.S. PATENT DOCUMENTS

| | | | |
|---|---|---|---|
| 2,266,662 | 12/1941 | Spanner et al. | 315/60 X |
| 2,298,581 | 10/1942 | Abadie | 315/62 X |
| 2,301,670 | 11/1942 | Abadie | 315/62 X |
| 3,538,370 | 8/1968 | Hashimoto et al. | 313/493 X |
| 3,549,941 | 12/1970 | Friedmann | 315/58 |
| 3,611,009 | 10/1971 | McNeil | 315/62 |

*Primary Examiner*—Saxfield Chatmon, Jr.
*Attorney, Agent, or Firm*—Robert S. Smith

[57] ABSTRACT

The invention relates to a lamp unit provided with a mercury vapor discharge tube and a stabilization ballast which forms one mechanical whole therewith. This lamp unit is provided with a lamp base of a type which is customary for incandescent lamps.

In accordance with the invention the discharge tube is a low-pressure discharge tube having a relatively high arc voltage. This results in a lamp unit whose ballast portion is small.

1 Claim, 3 Drawing Figures

DISCHARGE LAMP UNIT INCLUDING INTEGRAL BALLAST

This is a continuation, of application Ser. No. 934,961, filed Aug. 18, 1978, now abandoned.

The invention relates to a lamp unit comprising a mercury vapor discharge tube and, forming one mechanical whole therewith, an inductive stabilization ballast for the discharge tube, the discharge tube being provided with at least two internal electrodes, a discharge path between those electrodes being electrically in series with the stabilization ballast, the lamp unit having only one lamp base provided with two electric terminals for cooperation with an a.c. voltage supply, the operating voltage of the lamp unit being S volts.

The operating voltage of the lamp unit must be understood to mean the r.m.s. value of the electric voltage with which this lamp unit must be operated.

A prior art lamp unit of the type indicated is, for example, disclosed in German Patent Specification No. 837,892. Such a lamp unit can, for example, replace an incandescent lamp. To this end the lamp base is of a type which is customary for incandescent lamp. It may, for example, be an Edison lamp base or a Swan Lamp base. This, of course, depends on the internal dimensions and fixing elements of a holder for the lamp unit.

A drawback of the indicated known lamp unit is that the inductive stabilization ballast is relatively big. As a result this lamp unit is rather bulky.

It is an object of the invention to provide a lamp unit of the type mentioned in the preamble wherein the inductive stabilization ballast can be small.

A lamp unit according to the invention, comprising a mercury vapor discharge tube and, forming one mechanical whole therewith, an inductive stabilization ballast for that discharge tube, the discharge tube being provided with at least two internal electrodes, a discharge path between those electrodes being electrically in series with the stabilization ballast, the lamp unit having only one lamp base provided with two electric terminals for cooperation with an a.c. voltage supply, the operating voltage of the lamp unit being S volts, is characterized in that the discharge tube is a low-pressure discharge tube whose arc voltage is between 0.54 S volt and 0.64 S volt.

In "a mercury vapor discharge tube and, forming one mechanical whole therewith, an inductive stabilization ballast", the expression "forming one mechanical whole" must be understood to mean forming an undetachable whole as well as a detachable whole. In the latter case the mechanical connection between the discharge tube and the stabilization ballast is, for example, a screw connection or a snap connection.

Here and in what follows hereafter arc voltage must be understood to mean the arc voltage in the operating condition of the lamp unit. That is to say the voltage between the electrodes after this switch-on or starting procedure of the lamp unit.

The following should be noted by way of explanation. With known inductive stabilized low-pressure mercury vapor discharge lamps the value of the arc voltage has a rule been chosen such that it amounts to half the r.m.s. value of the available a.c. voltage. This means that in the case of an a.c. voltage mains of nominal 220 Volts an arc voltage of approximately 110 Volts is chosen. If the arc voltage exceeds half the supply voltage, the electric lamp current—and consequently the luminance of the lamp—depends to a greater degree on the voltage variations of the supply mains. However, there is the advantage that a greater arc voltage—the electric lamp power being kept constant—results in a lower electric current through the lamp and through the stabilization ballast. Also the voltage across that ballast is then lower. All this implies that the inductive stabilization ballast can then be smaller in size.

If, in accordance with the invention, in case of an operating voltage S of the lamp 220 volt, the arc voltage of the discharge tube is chosen between 0.54 S volt and 0.64 S volt, that is between approximately 120 and 140 volts—instead of 110 volts—then the volume of the ballast can be reduced by approximately 10 to 20%. In addition, even at the upper limit 0.64 S volt (=140 volts) of the arc voltage the variation in the lumens value of the discharge tube at the customary mains voltage tolerance of ±10% (that is 198–242 volts) is lower than in the case where the average incandescent lamp is used.

In the case of a 220 volts supply voltage an arc voltage exceeding 140 volts results in excessive influences of mains voltage fluctuations on the luminance of the lamp and/or in restarting problems of the discharge tube after each half cycle of the mains supply. The latter is caused by the fact that the ballast is then, relatively, too small.

A similar exposition as given above also applies to the case of a lamp unit having a minimal operating voltage of, for example, 118 volts. Mains voltages of 118 volts ±10% are encountered then.

Using a low-pressure mercury vapor discharge tube in a lamp unit according to the invention has the advantage over the application in a lamp unit of a high-pressure mercury vapor discharge tube that the first-mentioned discharge tube has a considerably lower operating temperature than said last discharge tube. The thermal load of the ballast owing to the immediate proximity of the low-pressure mercury vapour discharge tube may, therefore, usually be smaller in a lamp unit according to the invention.

It should be noted that a low-pressure mercury vapor discharge tube having a relatively high arc voltage of 130 Volts is known per se, for example from Hasker, U.S. Pat. No. 4,163,169 also assigned to U.S. Philips Corporation as is the present application. This known discharge tube, however, is not part of a lamp unit wherein the discharge tube and an inductive stabilization ballast therefor form one mechanical whole.

In addition the following should be realised. In a lamp unit according to the invention the stabilization ballast is disposed in a place where its permissible temperature is higher than if this ballast were not part of the lamp unit, but were fitted, for example, somewhere else in a luminaire or in a ceiling of a room. This means that—the other conditions being identical—the stabilization ballast in the lamp unit can as a rule be smaller than in the case of a separate arrangement of the ballast. Added to this is the fact that—in a lamp unit according to the invention—the ballast can moreover be still further reduced in size by the choice of the relatively high voltage of the discharge tube.

The invention is therefore actually based on the choice of the location—and of the electric land—of the ballast; the thermal load of the ballast, by the choice of the type of the associated discharge tube, being kept at a minimum.

In a lamp unit according to the invention the discharge tube may, for example, be straight or curved. The relatively high arc voltage can, for example, be obtained by choosing the electrode spacing to be great or by giving the discharge tube a small inside diameter. It is also conceivable that, for obtaining a high arc voltage, the inside of the discharge tube comprises thinly distributed glass wool.

The discharge tube may or may not be provided with a fluorescent coating.

In a preferred embodiment of a lamp unit according to the invention the volume of the discharge space of the discharge tube is less than 40 $cm^3$. An advantage of this preferred embodiment is that the entire lamp unit may be of a small volume, namely because now a small ballast is combined with a small discharge tube.

With a next preferred embodiment of a lamp unit according to the invention the two electrodes of the discharge tube are of a preheatable type, the ends of the two electrodes which face electrically away from the lamp base being interconnected via a starter forming part of the lamp unit.

An advantage of this preferred embodiment is that the discharge tube can now be reliably ignited. The starter is, for example, a glow discharge starter.

Some embodiments of the invention will be further explained with reference to the drawings of which:

Figure 1:
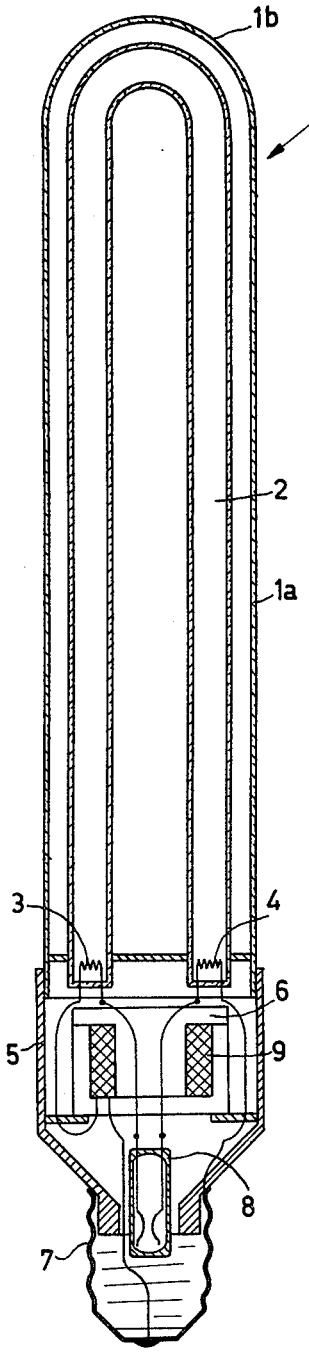
FIG. 1 shows a longitudinal section of a first lamp unit according to the invention.

In FIG. 1 reference 1 is a glass lamp envelope consisting of a tubular portion 1*a* which terminates in a semi-spherical portion 1*b*. Situated within the envelope there is a U-shaped low-pressure mercury vapor discharge tube 2, whose inner wall is provided with a fluorescent coating comprising trivalent europium-activated yttrium oxide, terbium-activated cerium magnesium aluminate and bivalent europium-activated barium magnesium aluminate. (See United Kingdom Patent Specification Nos. 1,458,700 and 1,452,083). A preheatable electrode 3 is present in one end of the discharge tube 2. A likewise preheatable electrode 4 is present in the other end of the discharge tube 2. In addition, the lamp unit comprises a housing 5, which accommodates an inductive stabilization ballast 6 for the discharge tube 2. Furthermore, the lamp unit is provided with an Edison lamp base, namely an E-27 lamp base. Reference 8 indicates a glow discharge starter which projects partly into lamp base 7. This glow discharge starter is used for igniting the discharge tube 2. To this end the starter 8 is connected between the ends, which electrically face away from the lamp base terminals, of the electrodes 3 and 4. The wall of the center portion 5 of the discharge tube consists of an insulating synthetic resin material.

The lamp unit described has a total length of approximately 32 cm and a greatest diameter of approximately 5 cm. The length of the discharge path between the electrodes 3 and 4 is approximately 43 cm. The inside diameter of the discharge tube 2 is approximately 0.8 cm. Consequently the volume of the discharge space of the discharge tube is approximately 22 $cm^3$, i.e. less than 40 $cm^3$.

This lamp unit is intended for connection to an a.c. supply voltage of nominally 220 Volts, 50 Hertz. Therefore the operating voltage S is 220 volts. In the operating condition of the lamp the arc voltage of the discharge tube is approximately 59% of S, i.e. 130 Volts. The lamp current is approximately 125 mAmpere. The power of the lamp unit is approximately 15 Watt. The luminous flux is approximately 1000 lumens. Therefore this lamp unit can replace an incandescent lamp of approximately 75 Watt.

The ballast 6 consists of a U-T laminated core, the window of which is provided with an electric coil 9. The ballast is approximately 2.5 cm high; the length and the width are each approximately 3.3 cm. The total volume of the ballast therefore amounts to approximately 25 $cm^3$. In the operating condition of the lamp unit the average temperature of the ballast 6 is approximately 120° Celsius.

Figure 2:
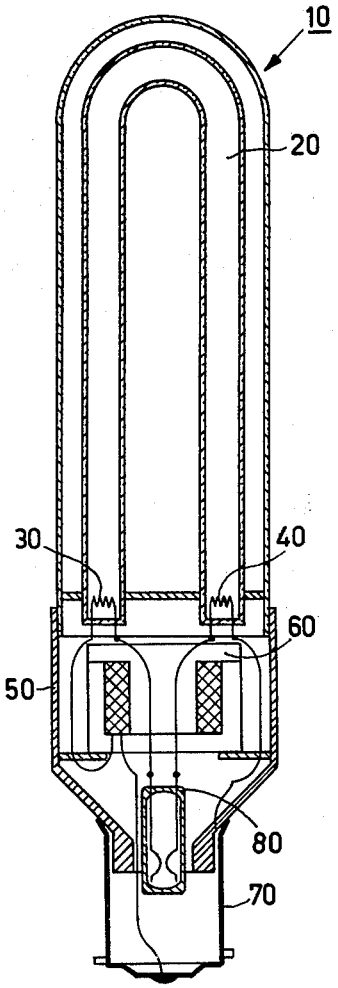
FIG. 2 shows a longitudinal section of a second lamp unit according to the invention.

FIG. 2 shows a second lamp unit according to the invention. The construction of this lamp unit is roughly the same as that of FIG. 1. However, the lamp unit of FIG. 2 is provided with a Swan lamp base 70 (B-22 lamp base) and is intended for connection to an a.c. voltage mains supply of approximately 118 volts, 60 Hertz. Therefore the operating voltage S is 118 Volts. The lamp unit of FIG. 2 might alternately be provided with an Edison lamp base, for example, with an E-26 lamp base.

FIG. 2 shows a U-shaped discharge tube 20, provided with electrodes 30 and 40, in a glass envelope 10. The inner wall of the tube 20 is provided with a fluorescent coating which contains the same luminescent materials as the lamp of FIG. 1. The arc voltage of the tube 20 is approximately 59% of S, that is to say 70 Volts. The lamp current is approx. 250 mAmperes. The power of the lamp unit is approximately 20 Watt. A ballast 60 in a center portion 50 of the lamp unit is approximately 2.5 cm high; its length is approximately 4 cm and its width approximately 3 cm. Therefore the volume of the ballast 60 is approximately 30 $cm^3$. The temperature of the ballast in the operating condition of the lamp unit is approximately 120° Celsius. Reference 80 is a glow discharge starter for igniting the discharge tube 20.

The lamp unit of FIG. 2 has an overall length of approximately 23 cm and a greatest diameter of approximately 5 cm. The length of the discharge path between the electrodes 30 and 40 is approximately 29 cm. The inside diameter of the discharge tube 20 is approximately 1 cm. Therefore the volume of the discharge space of that discharge tube is approximately 23 $cm^3$.

The lamp unit of FIG. 1 is of the "undetachable whole" type. The same holds for the lamp unit of FIG. 2.

Figure 3:
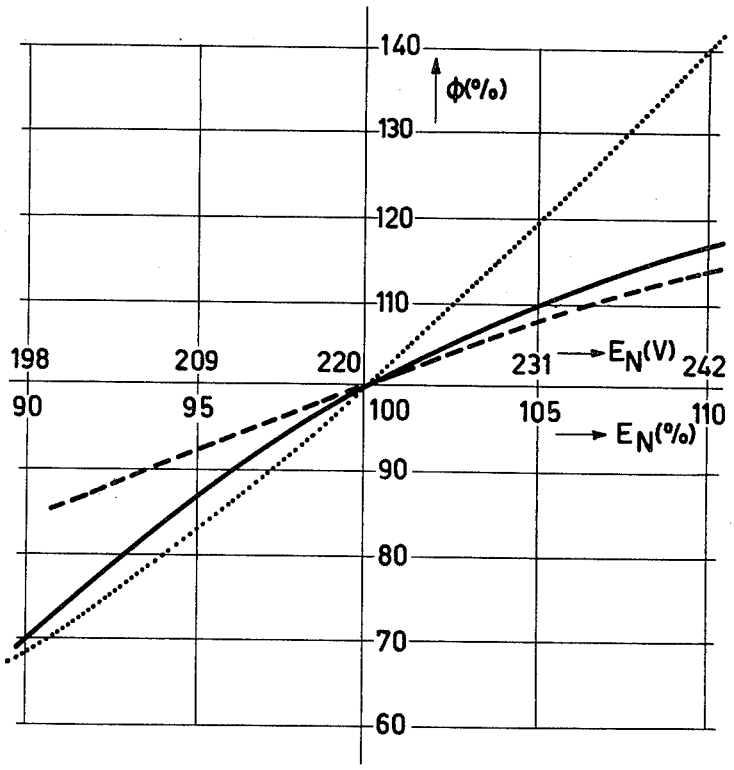
FIG. 3 is a diagram of the relative lumen value of some light sources, a lamp unit according to the invention included, plotted versus the electric supply voltage.

In FIG. 3 the relative luminous flux $\phi$, or the lumen value in percent, is plotted versus the r.m.s. value of the power supply voltage for three light sources. The starting point is a power supply of nominally 220 volts, 50 Hertz. The luminous flux $\phi$ at a power supply voltage of 220 Volts is assumed to be 100%. In FIG. 3 the relative luminous flux is plotted on the vertical axis and the r.m.s. value $E_n$ of the mains voltage on the horizontal axis. The value $E_n$ is indicated both in Volts and in percent of the nominal voltage value at the power supply.

In FIG. 3 the solid line indicates the voltage-dependency of the lumen value of the lamp unit—according to the invention—of FIG. 1. The dashed line relates to a low-pressure mercury vapor discharge lamp, not in accordance with the invention, having an arc voltage of only 110 Volts. The dotted curve of FIG. 3 relates to the behavior of an incandescent lamp of 75 Watt.

FIG. 3 shows that the lumen value of the considered lamp unit according to the invention depends indeed to a greater degree on power supply voltage fluctuations than a low-pressure mercury vapor discharge lamp—not according to the invention—having an arc voltage of 110 Volts, but that in this respect the lamp unit according to the invention is nevertheless better than an incandescent lamp in whose place that lamp unit could be used.

What is claimed is:

1. A lamp unit comprising a mercury-vapor discharge tube and an inductive stabilization ballast for said discharge tube, said ballast forming one mechanical whole with said discharge tube, said discharge tube being provided with at least two internal electrodes, a discharge path between said electrodes being electrically in series with said stabilization ballast, means for applying a voltage which is nominally S volts to the series connection of the discharge path and said stabilization ballast, said lamp unit having only one lamp base, said discharge tube being a low-pressure discharge tube whose arc voltage is between 0.54 S Volt and 0.64 S Volt, said lamp being substantially ballasted by said inductive stabilization ballast, the volume of the discharge space of the discharge tube being smaller than 40 cubic centimeters and said internal electrodes of the discharge tube are of a preheatable type.

* * * * *